US005900791A

United States Patent [19]

Hoffmann et al.

[11] Patent Number: 5,900,791

[45] Date of Patent: May 4, 1999

[54] ARMATURE-MOUNTING ARRANGEMENT FOR A HINGED-ARMATURE RELAY

[75] Inventors: Wolfgang Hoffmann; Andre Koerner; Maik Zimmer, all of Lippstadt, Germany

[73] Assignee: Hella KG Hueck & Co., Germany

[21] Appl. No.: 08/754,113

[22] Filed: Nov. 22, 1996

[30] Foreign Application Priority Data

Nov. 30, 1995 [DE] Germany ..... 195 44625

[51] Int. Cl.[6] ..... H01H 51/22

[52] U.S. Cl. ..... 335/78; 335/79; 335/80; 335/81; 335/82; 335/83; 335/84; 335/85; 335/86; 335/128; 335/270

[58] Field of Search ..... 335/78–86, 128, 335/270

[56] References Cited

U.S. PATENT DOCUMENTS

| | | | |
|---|---|---|---|
| 4,532,487 | 7/1985 | Nagamoto et al. | 335/128 |
| 4,720,694 | 1/1988 | Schroeder | 335/128 |
| 4,857,872 | 8/1989 | Bassino | 335/80 |
| 5,065,127 | 11/1991 | Mitschik et al. | 335/270 |
| 5,703,550 | 12/1997 | Pawlak et al. | 335/78 |

FOREIGN PATENT DOCUMENTS

| | | |
|---|---|---|
| 0 133 582 | 2/1985 | European Pat. Off. . |
| 0 337 097 | 10/1989 | European Pat. Off. . |
| 0 374 304 | 6/1990 | European Pat. Off. . |
| 2 541 815 | 8/1984 | France . |
| 1 489 972 | 5/1969 | Germany . |
| 37 07 786 A1 | 10/1987 | Germany . |
| 43 20 831 C1 | 7/1994 | Germany . |

*Primary Examiner*—Michael L. Gellner
*Assistant Examiner*—Tuyen T. Nguyen
*Attorney, Agent, or Firm*—Griffin, Butler, Whisenhunt & Szipl, LLP

[57] ABSTRACT

An armature-mounting arrangement for a hinged-armature relay includes a yoke (3), an armature (1) positioned at an end portion of the yoke, and an armature holding spring (2) which has at least one switching contact thereon and which is mechanically coupled to the armature. The armature holding spring is formed as one piece with a return spring (5) for the armature and also with spring hooks (4). Each of the spring hooks has a first portion (4*a*) lying substantially flat on an outer side of the armature and a second portion (4*b*) extending from the first portion about the armature and lying almost flat against an outer surface of the yoke. This armature-mounting arrangement is a particularly uncomplicated and cost effective structure and its operation is also not particularly sensitive to fabrication tolerances of the armature and the yoke.

3 Claims, 3 Drawing Sheets

ARMATURE-MOUNTING ARRANGEMENT FOR A HINGED-ARMATURE RELAY

BACKGROUND OF THE INVENTION

This invention concerns an armature-mounting arrangement for a hinged-armature relay of a type comprising a yoke, an armature positioned at an end-portion of the yoke, an armature-holding spring which has at least one switching contact thereon and which is mechanically coupled to the armature.

Such an armature-mounting arrangement is disclosed in German Patent DE 43 20 831 (C1). In this relay, special mounting bearings are provided between the armature and yoke, with at least one of the armature and the yoke having inclined support surfaces. A moving of the armature is thereby converted into a rotational movement, with the middle point of the switching contact being at a center of rotation, so that switching contacts which lie opposite one another are not displaced relative to one another. In this manner, a contact displacement which would cause an increased contact burning, which in turn would greatly reduce the life of the relay, is avoided.

A disadvantage of this well-functioning armature mounting arrangement is that a stamping out, or punching out, of parts for such an armature-mounting arrangement is relatively cost intensive, particularly because large fabrication tolerances are not permissible for the armature and the yoke.

This is true as well for relays in which armatures are mounted in recesses of yokes.

Cost factors for manufacturing punched or stamped armature-mounting parts, while maintaining narrow fabrication tolerances, can, for mass-produced products such as hinged armature relays, have considerable importance.

Thus, it is an object of this invention to provide an armature-mounting arrangement for a hinged-armature relay which is particularly uncomplicated and cost effective to fabricate and which is not sensitive relative to fabrication tolerances of the yoke and armature.

SUMMARY OF THE INVENTION

According to principles of this invention, an armature holding spring is formed as one piece with: two spring hooks, each having a first portion lying flat on an outer side of an armature and a second portion extending approximately at a right angle to the first portion about the armature, to lie almost flat on an exterior surface of the yoke, when the armature is at rest and a return spring, which also has an approximately right-angle bend relative to a length direction of the armature.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
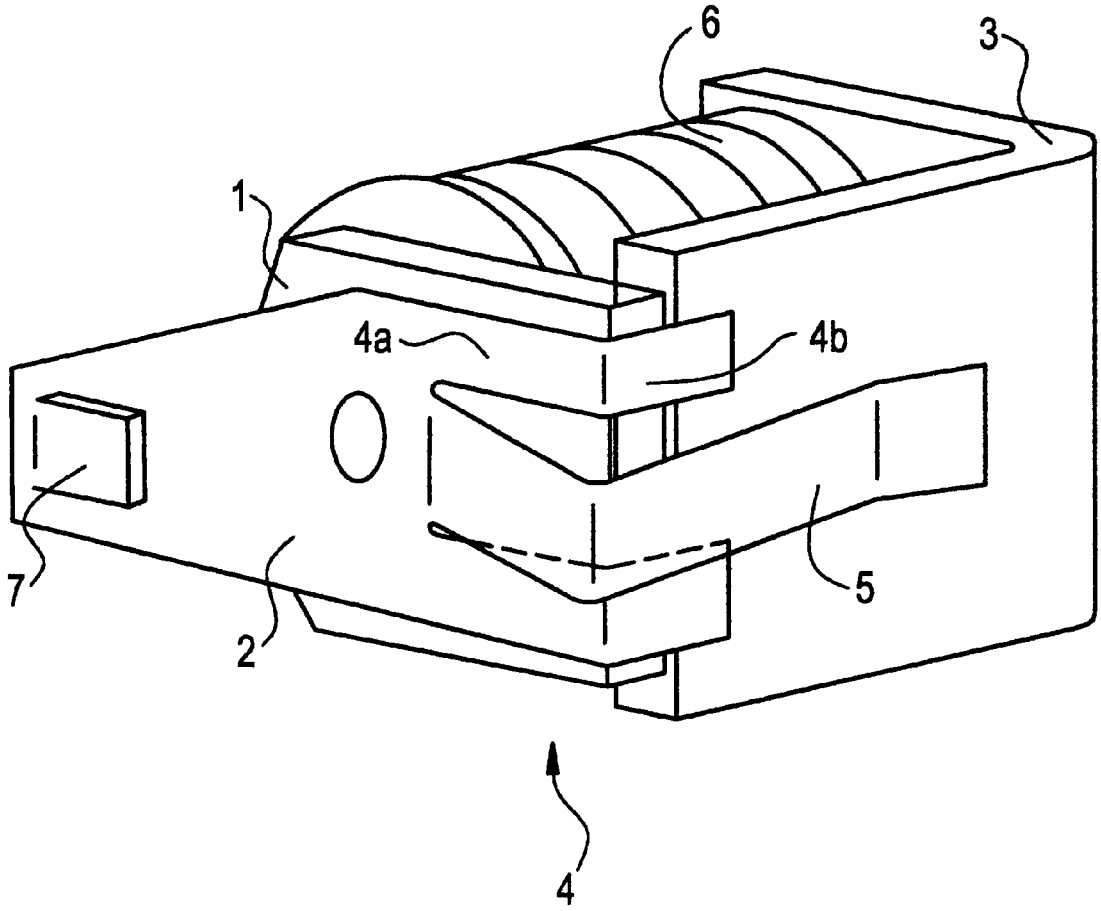
FIG. 1 is an isometric view of an armature-mounting arrangement of this invention in a schematic, principle-element-sketch, form.

FIG. 1 shows a principle-element-sketch of an armature-mounting arrangement of this invention, with parts of a hinged-armature relay not necessary for an explanation being left out.

A magnet coil 6 can be seen and an L-shaped yoke 3 lying about the magnet coil 6.

An armature 1 is mounted with an end portion of the armature 1 lying against an end edge of the yoke 3, there being, indeed, no shaped-key interengagement provided between the yoke 3 and the armature 1.

An armature holding spring 2 is riveted to the armature 1. Formed as one piece with the armature holding spring 2 are two spring hooks 4 of which each has a first portion 4*a* lying flat on an outer side of the armature 1 and a second portion 4*b,* extending approximately at a right angle to the first portion 4*a,* bent about the armature and lying almost flat against an exterior side of the yoke, when the armature 1 is in a rest position.

The armature holding spring 2 is also formed as one piece with a return spring 5 which likewise has an approximately right-angled bend relative to a length direction of the armature 1, with an end portion of the return spring being affixed at a suitable position (not shown in FIG. 1). This position can, in a beneficial manner, be a power terminal, through which a load current that is to be switched is applied to at least one switch contact 7.

A principle of the armature-mounting arrangement of this invention is that the mounting of the armature does not result from rigid mechanical limitations, rather from various spring forces of the armature holding spring 2. The return spring 5 creates, in this regard, a return-driving force on the armature for the magnet coil as well as also a force component along the length of the armature 1. By a resolution of these forces, the armature 1 is always guided back to its original position.

Figure 2:
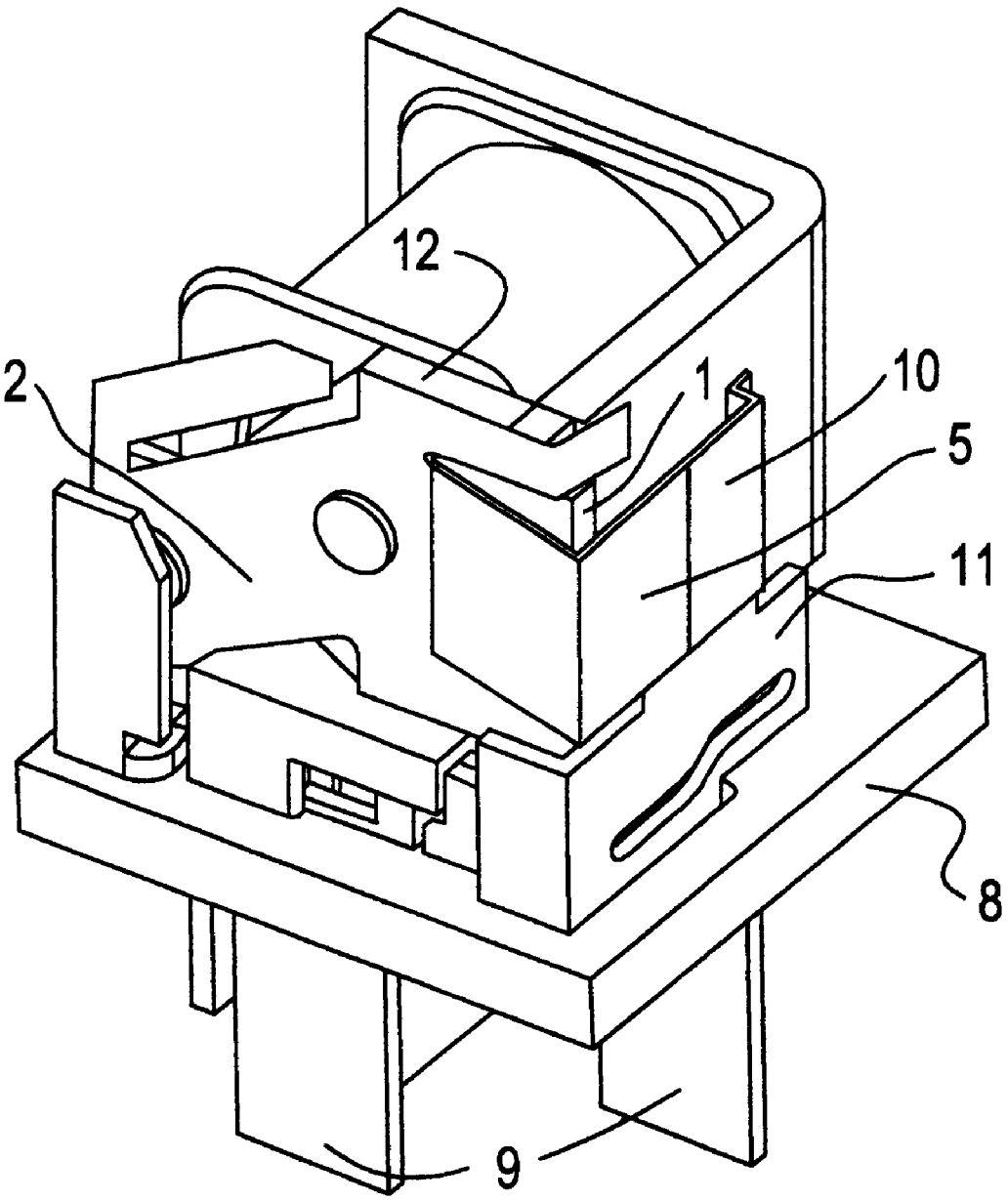
FIG. 2 is an isometric view of a electromagnetic relay having an armature-mounting arrangement of this invention.
Figure 3:
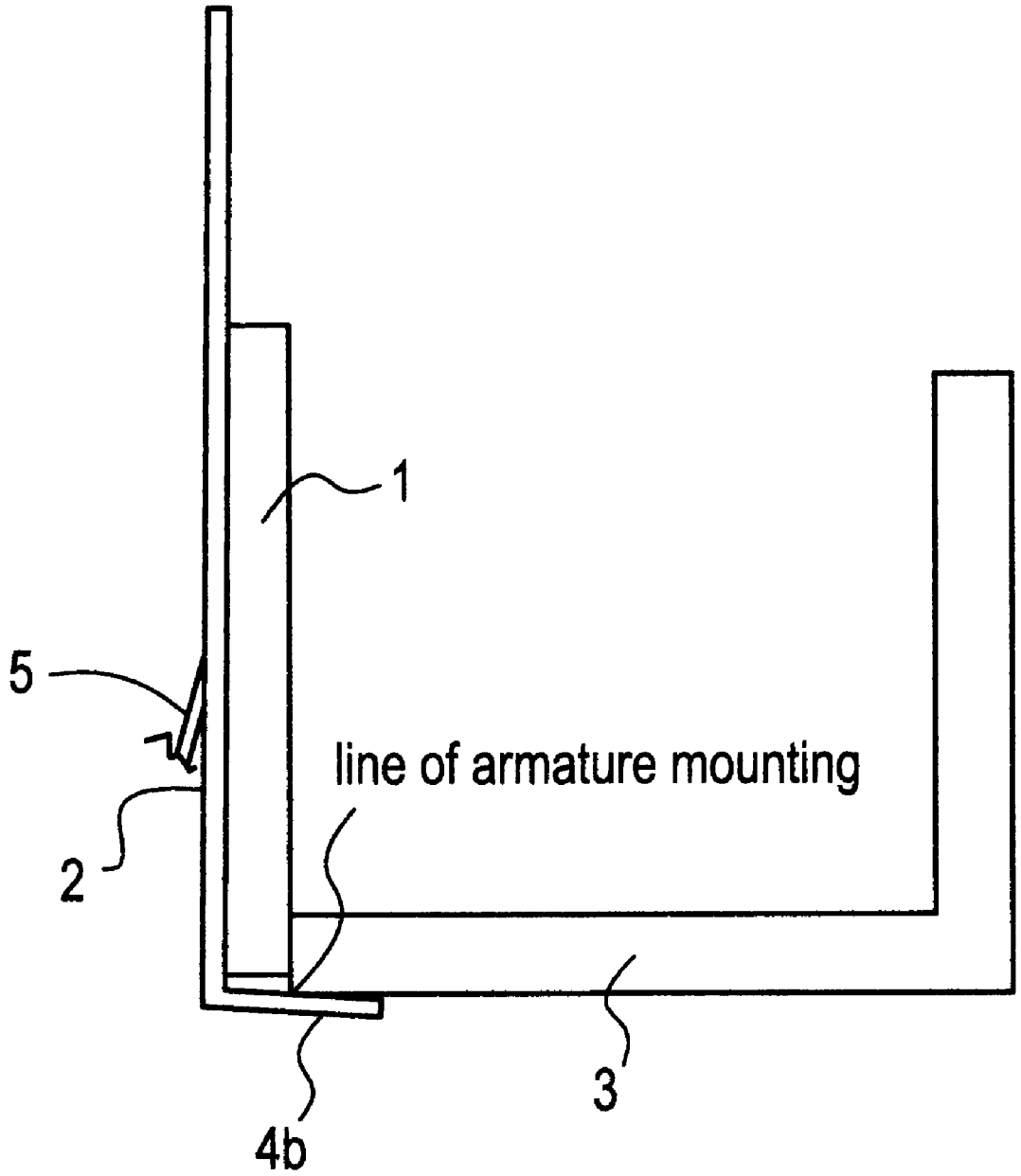
FIG. 3 is a fragmented, cutaway, side view of an armature holding spring, armature and yoke of the structure depicted if FIGS. 1 and 2.

For further clarification, FIG. 2 shows a completely mounted relay which has an armature-mounting arrangement of this invention.

The relay is mounted on a ground plate 8 and has a plurality of terminals which form flat plugs on an underside of the ground plate 8.

An end portion of the return spring 5 is affixed to an end of one of the terminals 11. By bending this terminal 11, a bias of the return spring 5, and thereby the armature holding spring 2, is influenced so that, in turn, a minimum response voltage of the relay is influenced.

In a further beneficial enhancement, as can be seen in FIG. 2, a portion 12 of the armature holding spring 2 extends about a length edge of the armature 1, whereby the armature holding spring 2 is prevented from rotating relative to the armature 1.

The armature-mounting arrangement of this invention is beneficial in many ways. A relay with an armature-mounting arrangement of this invention can be manufactured in a particularly uncomplicated and cost effective manner because it can be made of a significantly small number of parts since the flat-shaped spring, which is attached to the armature, is made as one piece with the switch-contact spring as well as with the return spring for the armature and also the spring hooks for the armature mounting arrangement. Further spring-force-applying components are, advantageously, not needed.

It is likewise beneficial that the yoke as well as also the armature can be constructed in an uncomplicated manner and have no particular indentations or cuts. Thus, manufacture of these components is quite simple and cost effective, and also their smoothness tolerances can be quite great.

The positions of the switch contacts relative to one another are, with the armature mounting arrangement of this invention, still only determined by the flat-shaped spring, and not, however, by the armature, whereby a tolerance chain, from which contact wear depends, can be shortened.

The armature-mounting arrangement, thus, makes possible that the armature and the armature holding spring can move relatively freely, compared to a fixed contact in a defined frame, with movement play not being determined by mechanical end stops but rather by spring-effect, dampened, limits. In this manner, with an increasing life of the contacts, increased contact burning, and an increased danger of a mechanical sticking of the originally moveable contacts, is prevented. Accordingly, limitations against armature-movements which bring about life-time reducing contact displacements are maintained.

Further beneficial enhancements and improvements can be made.

For example, it is beneficial, that portions of the armature holding spring wrap around the length end of the armature whereby a rotation of the armature holding spring relative to the armature is prevented in an uncomplicated manner.

Likewise, it is beneficial to have the free end portion of the return spring affixed to a power terminal and to have the current flow to the moveable switch contacts along the return spring because in this manner the switch contacts of the load current flows directly through a wide and low-resistant portion of the armature holding spring so that one can also eliminate normally used of current lines—such as, for example, braided copper bands, or the like. Further, by bending the power terminal which is attached to the return spring, the return force of the return spring, and thereby also the minimum response voltage of the relay can be influenced in an uncomplicated manner.

While the invention has been particularly shown and described with reference to a preferred embodiment, it will be understood by those of ordinary skill in the art that various changes in form and detail may be made therein without departing from the spirit and scope of the invention.

The invention claimed is:

1. Armature-mounting arrangement for a hinged-armature relay including a yoke, an armature positioned at an end portion of the yoke, and an armature holding spring which has at least one switching contact thereon and which is mechanically attached to the armature:

Wherein the armature spring is formed as one piece with at least two spring hooks, with each spring hook having a first portion lying substantially flat on an outer side of the armature and a second portion forming a hook free end extending approximately at a right angle to the first portion about the armature and lying almost flat on an exterior surface of the yoke when the armature is at rest, said second portion of said hooks not being mechanically attached to said yoke; wherein the armature holding spring is also constructed as one piece with a return spring, which also has an approximately right-angle bend relative to a length axis of the armature for forming a spring free end portion extending along said exterior surface of the yoke; and wherein a line of an armature-mounting is defined by a line at an intersection between a plane of the second portions of the spring hooks and a plane of the armature.

2. Armature-mounting arrangement as in claim 1 wherein said armature is elongated and a portion of the armature holding spring grips about a longer edge of the armature, and the second portion of each hook extends about a shorter edge of the armature.

3. Armature-mounting arrangement as in claim 1 wherein said spring free end portion of the return spring is affixed to a power terminal and wherein current flows to the at least one switching contact via the return spring.

* * * * *